US009194388B2

(12) United States Patent
Laermer et al.

(10) Patent No.: US 9,194,388 B2
(45) Date of Patent: Nov. 24, 2015

(54) MICRO-DOSING PUMP HAVING A ROTATABLE VALVE DISK DRIVEN BY A MAGNETIZED ACTUATOR DISK

(71) Applicant: Robert Bosch GmbH, Stuttgart (DE)

(72) Inventors: Franz Laermer, Weil Der Stadt (DE); Arne Dannenberg, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 332 days.

(21) Appl. No.: 13/736,116

(22) Filed: Jan. 8, 2013

(65) Prior Publication Data

US 2013/0183170 A1 Jul. 18, 2013

(30) Foreign Application Priority Data

Jan. 13, 2012 (DE) ..... 10 2012 200 501

(51) Int. Cl.
*F04B 43/02* (2006.01)
*F04B 53/10* (2006.01)
*F04B 43/04* (2006.01)

(52) U.S. Cl.
CPC ..... *F04B 43/02* (2013.01); *F04B 43/043* (2013.01); *F04B 53/106* (2013.01); *Y10T 29/49236* (2015.01)

(58) Field of Classification Search
CPC ..... F04B 43/043; F04B 43/046; F04B 43/02; F04B 43/021; F04B 43/028; F04B 53/105; F04B 53/1052; F04B 53/1055; F04B 53/106; F04B 53/1062; F04B 53/1065; F16J 3/02; F16J 3/06; A61M 2205/0294
USPC ..... 417/413.1, 420, 549, 562; 92/96
See application file for complete search history.

(56) References Cited

U.S. PATENT DOCUMENTS

2002/0136649 A1* 9/2002 Wolf et al. ..... 417/413.1
2006/0233648 A1* 10/2006 Liu et al. ..... 417/53
2007/0128055 A1 6/2007 Lee

FOREIGN PATENT DOCUMENTS

EP 1966490 B1 9/2008
JP 2009-156242 A 7/2009
WO 2007/074363 A2 7/2007

* cited by examiner

*Primary Examiner* — Charles Freay
*Assistant Examiner* — Kenneth J Hansen
(74) *Attorney, Agent, or Firm* — Maginot, Moore & Beck LLP

(57) ABSTRACT

A micro-dosing pump includes a pump chamber substrate, a flexible membrane, a fluid line, a valve disk, a magnetizable actuator disk, and a drive unit. The pump chamber substrate has a pump chamber. The flexible membrane is on a first side of the pump chamber substrate and covers the pump chamber in a fluid-tight manner. The fluid line is on a second side of the pump chamber substrate such that fluid can enter and leave the pump chamber. The valve disk, arranged inside the pump chamber, has a fluid through-opening and is configured to close the fluid line by rotating and to open it via the through-opening. The actuator disk is coupled to the valve disk such that rotating the actuator disk rotates the valve disk. The drive unit has a pump plunger configured to move the membrane for suction or ejection of fluid and to rotate the actuator disk.

12 Claims, 6 Drawing Sheets

MICRO-DOSING PUMP HAVING A ROTATABLE VALVE DISK DRIVEN BY A MAGNETIZED ACTUATOR DISK

This application claims priority under 35 U.S.C. §119 to patent application no. DE 10 2012 200 501.3, filed on Jan. 13, 2012 in Germany, the disclosure of which is incorporated herein by reference in its entirety.

BACKGROUND

The present disclosure relates to a micro-dosing pump and to a method for producing a micro-dosing pump.

Micro-dosing pumps are often complicated and expensive to produce if, at the same time, it is necessary to meet the stringent demands regarding their inherent safety functions. For insulin pumps for example, it is necessary to guarantee that no discharge of insulin can inadvertently take place under any circumstances, since this can have serious consequences for the health of patients. The high-precision dispensing of the required dose quantities must therefore be guaranteed under all circumstances.

Although the modified axial piston pump from EP 1 966 490 B1, which is based on injection-molded components, provides all safety features while being relatively inexpensive to produce, there are certain limits here to the degree of miniaturization, since it involves a three-dimensional arrangement of individual 3D components, which also have to be three-dimensionally structured on the sides, for example. The required manufacturing tolerances in this case dictate certain minimum dimensions, and the piston requires a minimum length for a functioning piston guide.

SUMMARY

The disclosure makes available a micro-dosing pump having the features described below, and a method that is used to produce a micro-dosing pump and that has the features described below.

The following is accordingly provided:

A micro-dosing pump, with a pump chamber substrate having a pump chamber, with a flexible membrane, which is provided on one side of the pump chamber substrate in such a way that it covers the pump chamber in a fluid-tight manner, with at least one fluid line, which is provided on a second side of the pump chamber substrate in such a way that a fluid can enter and leave the pump chamber, with a rotatable valve disk having at least one fluid through-opening, which valve disk is arranged inside the pump chamber and is configured to close the fluid line by a rotation and to open it via the fluid through-opening, with an in parts permanently magnetized or magnetizable actuator disk, which is coupled to the valve disk via at least one resiliently elastic element in such a way that a rotation of the actuator disk results in a rotation of the valve disk, wherein the resiliently elastic element presses the valve disk and the actuator disk away from each other, with a drive unit having a magnetic pump plunger, which is configured to move the membrane for the suction or ejection of fluid, and is configured to rotate the permanently magnetized or magnetizable actuator disk.

A method for producing a micro-dosing pump according to the disclosure is also provided, said method having the following method steps: (A) the pump chamber substrate having the pump chamber is made available; (B) the valve disk and the actuator disk are arranged in the pump chamber; (C) a magnetic field is generated in such a way that the valve disk and the actuator disk are drawn into the pump chamber and are fixed there; (D) the membrane is attached to the pump chamber substrate.

The present disclosure makes available a micro-dosing pump that is configured as a planar component. The membrane, the valve disk and the actuator disk are substantially flat. Therefore, this micro-dosing pump can have a particularly flat and miniaturized configuration. According to the disclosure, the at least one fluid line in the pump chamber substrate can be actively closed or opened by a rotation of the valve disk. By means of this active control, the micro-dosing pump according to the disclosure can achieve high suction pressures and ejection pressures. Moreover, on account of the controllable valve disk, the micro-dosing pump according to the disclosure is tolerant to gas bubbles.

The micro-dosing pump according to the disclosure is particularly suitable for the safe dosing and dispensing of small quantities of liquid (0.01-100 μl/min), e.g. in the dosing of medicines, in particular of insulin in insulin pumps. The micro-dosing pump according to the disclosure is particularly preferably used in an insulin pen, that is to say a medical appliance the size of a writing pen, which has an application in intensive insulin therapy.

On account of the resiliently elastic element, the actuator disk is especially able to lift the membrane rapidly from the lower position again when the micro-dosing pump is intended to suck fluid into the pump chamber. This permits active and rapid suction despite the fact that a pump plunger is not rigidly connected to the membrane. Since the valve disk is at all times pressed firmly against the floor of the pump chamber on account of the resiliently elastic element, it can very effectively seal the at least one fluid line.

In the micro-dosing pump structure according to the disclosure, no trailing sealing lips are needed to seal off the fluid line. Moreover, the micro-dosing pump according to the disclosure does not have the sealing and wear problems of a pump with a movable piston which at the same time has to be moved up and down and also rotated while maintaining the full sealing effect.

The pump plunger preferably has a magnet and is moved cyclically in the vertical direction via a suitable so-called phase, such that volume is sequentially displaced and again suctioned. This phase is applied in the drive unit. According to the disclosure, the opening and closing of fluid lines in the pump chamber are controlled via the rotation of the actuator disk, such that in total only a single actuator with a combined rotation and stroke movement is needed to operate the micro-dosing pump.

Advantageous embodiments and developments are set forth in the further description below and will become clear from the description given with reference to the figures of the drawing.

In one embodiment, the drive unit has an electric motor. The electric motor can be used here for the stroke of the pump plunger for the excursion of the elastic membrane, and for the rotation of the pump plunger for controlling the actuator disk. Of course, the drive unit can also have pneumatic and/or hydraulic actuators, which can move the pump plunger up and down and rotate it.

In another embodiment, the drive unit has a sensor, which detects the stroke of the pump plunger. The sensor can be a Hall sensor, for example. By monitoring the stroke of the pump plunger, it is possible to detect both the volume dispensed by the micro-dosing pump and also any bubbles and blockages.

In another embodiment, the actuator disk has a recess in which a permanently magnetized or magnetizable rod is provided. Examples of materials that can be used for the rod are iron, cobalt, nickel, ferrite and/or neodymium. A permanent magnet has the advantage, on the one hand, that the coordination of the pump plunger to the actuator disk is unambiguously defined and, on the other hand, that forms other than a rod can also be used, as long as different magnetic poles lie in the rotation plane. Material that is not permanently magnetized or magnetizable has the advantage that different inexpensive materials or production processes can be used. If necessary, the rod can be hermetically sealed in the recess, e.g. by welding a cover onto the recess and/or hermetically filling the recess.

In another embodiment, the valve disk, the actuator disk, the resiliently elastic element and/or the pump chamber substrate are made from a plastic. For example, the valve disk, the actuator disk, the resiliently elastic element and/or the pump chamber substrate can be produced by injection molding from, for example, polycarbonate, polypropylene, PVC, polystyrene, Teflon, PFPE, etc. However, other materials, e.g. metals and/or semiconductor materials, are also conceivable.

In another embodiment, the valve disk and/or the resiliently elastic element are micro-punched. In this way, the costs of producing the micro-dosing pump can be reduced. However, other methods can also be used to produce the valve disk and/or the resiliently elastic element, for example laser cutting, thermal separation, plasma etching and/or etching.

In another embodiment, the fluid through-opening of the valve disk has the shape of an arc or of a circle. Combinations of circles and arcs are of course also conceivable.

In another embodiment, the drive unit is configured as a durable unit, and the pump chamber substrate, the membrane, the actuator disk and the valve disk are configured as a disposable unit. A durable unit is to be understood, for example, as a reusable device. A disposable unit is to be understood, for example, as a replaceable, non-permanent device. By means of such an embodiment, the operating costs for the micro-dosing pump can be lowered, since it is possible to replace only the devices that show signs of wear or in particular of contamination by the delivered fluid, e.g. insulin preparations.

In another embodiment, the resiliently elastic element is configured as a beam spring, plate spring and/or spiral spring. The resiliently elastic element is preferably configured in such a way that it has only a translatory degree of freedom. In this way, it is possible to transfer the torque from the actuator disk to the valve disk while avoiding tilting of the valve disk.

In another embodiment, the membrane and the resiliently elastic element are formed in one piece. In this way, the dead volume is markedly reduced, and the suction ability of the micro-dosing pump can thus be improved. In this embodiment, the membrane is slightly thicker, such that it can readily assume the function of the resiliently elastic element. In this embodiment, the transfer of the torque from the pump plunger to the actuator disk can take place via a mechanical coupling. For example, the torque can be transferred by form-fit engagement or by force-fit engagement.

In another embodiment, the membrane is made from a thermoplastic elastomer film or from a structured thermoplastic. For example, the membrane is made from Platilon or polycarbonate. In particular, a Boss membrane with a circular cylindrical reinforcement in the middle is very suitable for the micro-dosing pump according to the disclosure. For example, the membrane has a thickness of ca. 100-1000 μm in the middle and a thickness of ca. 20-100 μm at the edge.

In another embodiment, the membrane is attached to the pump chamber substrate by adhesion, ultrasonic welding, solvent bonding and/or laser transmission welding. Other attachment methods can, of course, also be used.

The above embodiments and developments can, where appropriate, be combined with one another in any desired way. Other possible embodiments, developments and implementations of the disclosure comprise combinations, even where not explicitly stated, of features of the disclosure that have been described above or will be described below in respect of the illustrative embodiments. In particular, a person skilled in the art will also add individual aspects as improvements or additions to the respective basic form of the present disclosure.

BRIEF DESCRIPTION OF THE DRAWINGS

The present disclosure is explained in more detail below on the basis of the illustrative embodiments depicted in the schematic figures of the drawings, in which.

Figure 1:
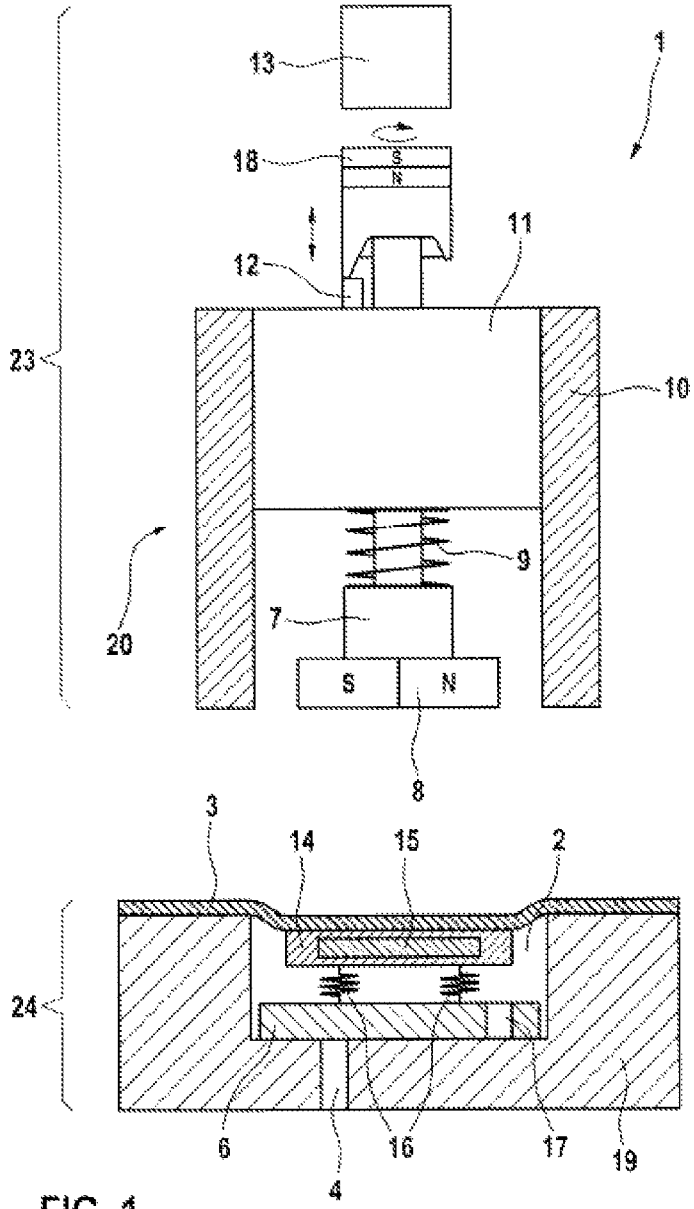
FIG. 1 shows a schematic sectional view of a micro-dosing pump.

The attached drawings are intended to impart a further understanding of the embodiments of the disclosure. They depict embodiments and, in conjunction with the description, serve to explain principles and concepts of the disclosure. Other embodiments and many of the advantages mentioned are evident from the drawings. The elements of the drawings are not necessarily shown in a manner true to scale with respect to one another.

In the figures of the drawing, unless otherwise stated, elements, features and components that are identical, have an identical function and have an identical action are provided in each case with the same reference signs.

DETAILED DESCRIPTION

FIG. 1 shows a schematic sectional view of a micro-dosing pump 1. The micro-dosing pump principally has a durable unit 23 and a disposable unit 24. The disposable unit 24 has a pump chamber substrate 19, with a pump chamber 2 provided in the latter. The pump chamber substrate 19 can be formed, for example, by injection molding from polycarbonate, polypropylene, PVC, polystyrene, Teflon and/or PFPE. However, other materials such as metals and/or semiconductor materials are also suitable for producing the pump chamber substrate 19. On one side of the pump chamber substrate, a flexible membrane 3 is connected to the pump chamber substrate 19 in a fluid-tight manner. The pump chamber substrate 19 has at least one fluid line 4, which allows a fluid to enter and leave the pump chamber 2 of the pump chamber substrate 19.

Moreover, a rotatable valve disk 6 is arranged in the pump chamber 2. The rotatable valve disk 6 has a fluid through-opening 17 and is arranged over the fluid line 4. By means of a rotation of the valve disk 6, it is possible, with the aid of the fluid through-opening 17, to alternately open or close the fluid line 4. The valve disk 6 is coupled to the valve disk 6 via at least one resiliently elastic element 16, in such a way that a rotation of the actuator disk 14 results in a rotation of the valve disk 6. Moreover, the resiliently elastic element 16 has the function of pressing the valve disk and the actuator disk away from each other. In this way, fluid can be sucked into the pump chamber 2 without an additional actuator. Moreover, the resiliently elastic element 16 presses the valve disk 6 against the floor of the pump chamber substrate 19, such that the valve disk 6 seals off the fluid line 4 in a fluid-tight manner.

The drive unit 20 is arranged above the disposable unit 24. The drive unit 20 has a pump plunger 7, by means of which the membrane can be lifted and lowered for sucking and pumping fluid into the pump chamber 2. A pump plunger magnet 8 is arranged on the pump plunger 7. The pump plunger magnet 8 interacts with a permanently magnetized or magnetizable rod 15, which is arranged in the actuator disk 14. With the aid of the pump plunger magnet 8, the actuator disk 14 can be rotated in the pump chamber 2 via magnetic coupling, wherein a rotation of the actuator disk 14 results in a rotation of the valve disk 6. By means of an actuator 11, the pump plunger 7 can, on the one hand, be moved up and down in order to cause an excursion of the membrane 3 and, on the other hand, can be rotated about its longitudinal axis in order to cause a rotation of the actuator disk 14. The pump plunger 7 can thus assume all the functions that are needed for a pumping procedure. The pump plunger magnet can be configured like the magnet provided in the actuator disk. An electro-magnet can also be used for the pump plunger magnet 8.

A restoring spring 9 is provided on the pump plunger 7. The restoring spring 9 preferably lowers the pump plunger 7 in such a way that, in the relaxed state of the restoring spring 9, the membrane 3 is located in a lower position. The actuator 11 of the drive unit 20 is an electromagnetic motor, for example. However, pneumatic and/or hydraulic drive systems can also be used for the actuator 11. The actuator 11 is enclosed by a holder 10 and held by the latter. Moreover, the front face of the holder 10 acts as an abutment for the top of the disposable unit 24 and ensures a height adjustment of pump plunger magnet 8 with respect to membrane and to actuator disk 14. At one end of the pump plunger 7, a magnet 18 is provided which functions as sensor transmitter 18 for a sensor 13 arranged above the magnet 18. The sensor 13 is a Hall sensor, for example. The stroke of the pump plunger can therefore be detected from the distance between the magnet 18 and the sensor 13. Moreover, an abutment 12 is provided by which the excursion of the pump plunger 7 is limited.

Figure 2:
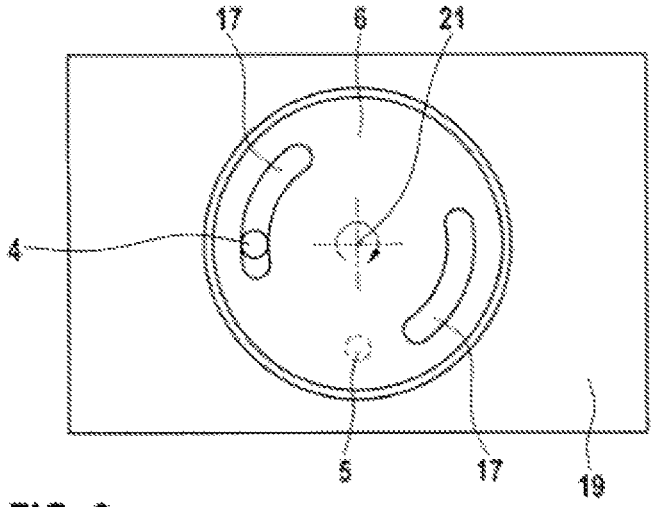
FIG. 2 shows a schematic plan view of the pump chamber substrate and of the valve disk.

FIG. 2 shows a schematic plan view of the pump chamber substrate 19 and of the valve disk 6. The valve disk 6 has two elongate, crescent-shaped fluid through-openings 17. The fluid through-openings 17 cyclically free the fluid lines 4 and 5, such that fluid can be suctioned or ejected. The valve disk 6 rotates about the rotation axis 21. The angle of rotation is predetermined by the magnet 8 secured on the pump plunger 7. A lateral guide is ensured by the side wall of the pump chamber substrate. To ensure that the valve disk 6 is not drawn away from the fluid lines 4 and 5 by the magnet 8 of the pump plunger 7, the magnetic coupling is effected via the actuator disk 14. The rod 15 of the actuator disk 14 is either a permanent magnet, which would have the advantage of unambiguous coupling to the magnet 8 of the pump plunger 7, or a magnetizable rod, which would have the advantage of permitting a wider choice of material for the magnet 15 of the actuator disk 14.

If the rod 15 has no permanent magnetization, two coupling variants are possible that are offset by 180 degrees relative to each other. In order to ensure an unambiguous pump direction, the fluid line 4, which functions as fluid inlet line in this illustrative embodiment, should be in the same state upon rotation of the valve disk 6 every 180°, i.e. should be opened and closed at least twice, or a multiple thereof, upon a complete 360° rotation about the rotation axis 21. This corresponds to a pump symmetry of the fluid through-openings 17 in the valve disk in relation to the rotation axis 21. If the same fluid through-opening 17 is used to control both fluid lines 4 and 5, i.e. fluid lines 4 and 5 have the same radial distance from the rotation axis 21, then the fluid through-openings 17 should be arranged at the distance of a 90° rotation or an integral fraction thereof. To ensure that at least one fluid line 4, 5 is at all times closed, the elongate fluid through-openings 17 should be made correspondingly short—less than a quarter circle. If fluid lines 4 and 5 are at different radial distances from the rotation axis 21, such that the fluid through-openings 17 exclusively control fluid line 4 and two additional crescent-shaped fluid through-openings exclusively control fluid line 5, then fluid lines 4 and 5 can be arranged at any desired angle with respect to one another and with respect to the rotation axis 21, provided that fluid through-openings 17 and the two additional fluid through-openings are arranged in such a way that fluid lines 4 and 5 are opened and/or closed at the correct moment in order to ensure an unambiguous direction of transport of fluid.

By contrast, if a permanent magnet 15 is arranged in the actuator disk 14, then the coordination of the pump plunger 7 is unambiguous. Thus, just a single crescent-shaped fluid through-opening 17 can also suffice to perform a simple pump cycle, or in each case a fluid through-opening 17 and an additional fluid through-opening arranged at a different radial distance therefrom, if both fluid lines 4 and 5 are at different radial distances from the rotation axis 21.

FIGS. 3, 4, 5, 6 and 7 show a complete pump cycle of the micro-dosing pump.

Figure 3:
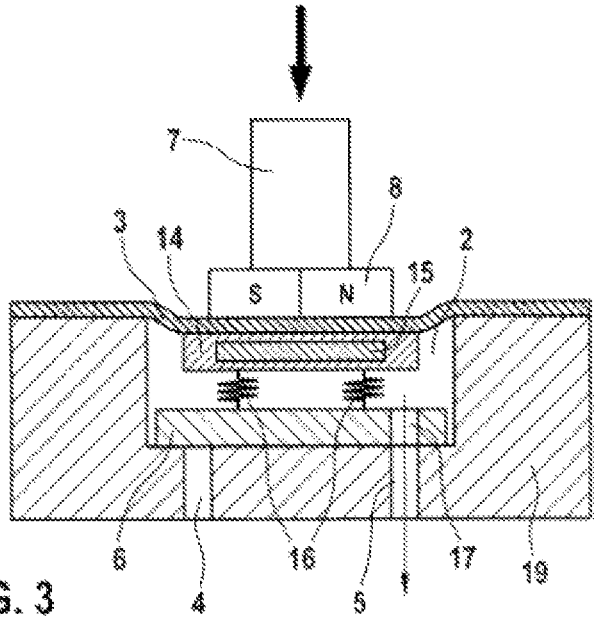
FIGS. 3-7 show a complete pump cycle of the micro-dosing pump.

FIG. 3 shows a schematic sectional view of an embodiment of the micro-dosing pump 1 in the state in which fluid leaves the pump chamber 2. The membrane 3 is pressed downward by the pump plunger 7. An overpressure thus develops in the pump chamber 2, as a result of which the fluid arranged in the pump chamber 2 is forced through the fluid through-opening 17 into the fluid line 5 and then leaves the pump chamber 2.

Figure 4:
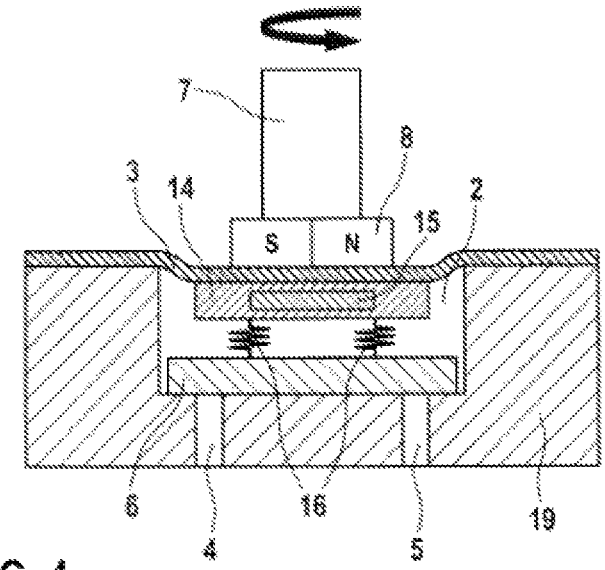

FIG. 4 shows a schematic sectional view of the micro-dosing pump 1 with closed fluid lines 4 and 5. After the fluid has been ejected from the pump chamber 2, the fluid lines 4 and 5 are closed by the valve disk 6. The closure of the fluid lines 4 and 5 is effected by a rotation of the valve disk 6 about the rotation axis 21. For this purpose, the pump plunger 7 is rotated about its longitudinal axis, wherein the magnet 8 of the pump plunger 7 interacts via magnetic coupling with the permanently magnetized or magnetizable rod 15 in the actuator disk 14. The rotation of the actuator disk 14 is transferred to the valve disk 6 via the resiliently elastic element 16.

Figure 5:
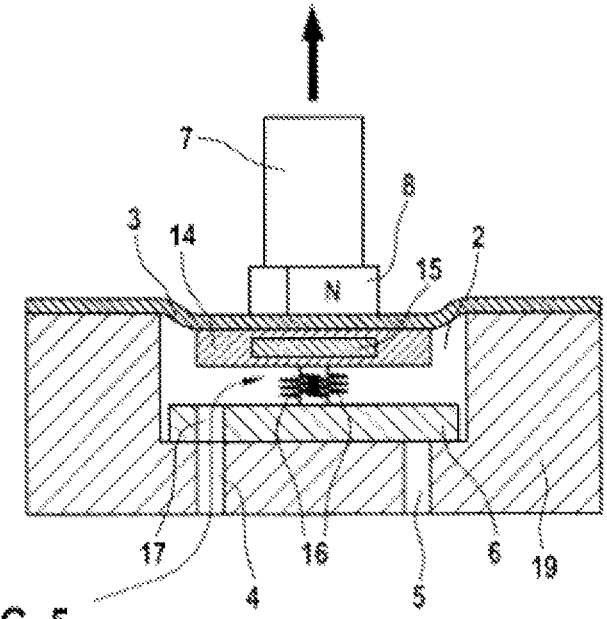

FIG. 5 shows a schematic sectional view of the micro-dosing pump 1 during suction of fluid through the pump chamber. The valve disk 6 has been turned in such a way that the fluid through-opening 17 of the valve disk frees the fluid line 4, as a result of which a fluid is allowed to enter the pump chamber 2. The excursion of the membrane 3 can be effected with the aid of the resiliently elastic element 16, which presses the actuator disk 14 away from the valve disk 6. Moreover, it is also possible that the magnet 8 of the pump plunger 7 assists the upward movement of the membrane 3.

Figure 6:
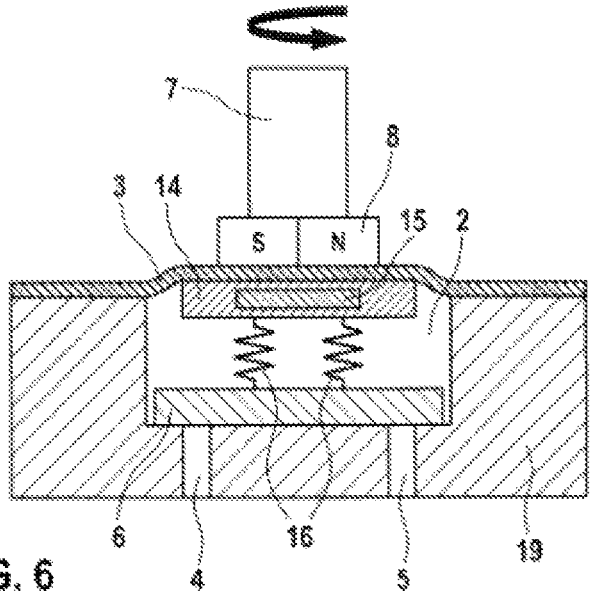

FIG. 6 shows a schematic sectional view of the micro-dosing pump 1. In the state of the micro-dosing pump 1 as shown, the membrane 3 is located in an upper position, wherein the actuator disk 14 and the valve disk 6 are pressed away from each other by the resiliently elastic element 16. After the fluid has been sucked into the pump chamber 2, the fluid lines 4 and 5 at the floor of the pump channel substrate 19 are again closed by means of further rotation of the valve disk 6 about the rotation axis 21.

Figure 7:
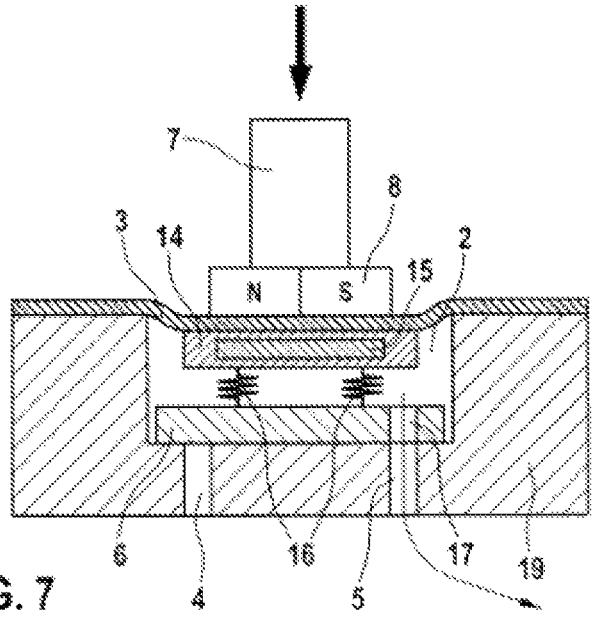

FIG. 7 shows a schematic sectional view of the micro-dosing pump 1 during ejection of fluid from the pump chamber 2. FIG. 7 differs from FIG. 3 in that the magnet 8 of the pump plunger 7 has now executed a 180° rotation, and ejection of the fluid from the pump chamber 2 can again take place.

Figure 8:
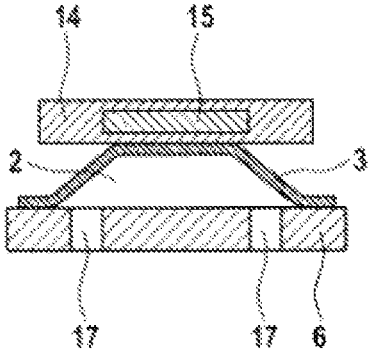
FIG. 8 shows a schematic sectional view of an embodiment of the membrane.

FIG. 8 shows a schematic sectional view of an embodiment of the membrane 3. In this embodiment, the membrane 3 and the resiliently elastic element 16 are formed in one piece. This can be achieved if the membrane 3 is made from an elastic material that can assume the function of the resiliently elastic element 16. In this illustrative embodiment, the membrane 3 is configured in such a way that a torque, which is applied to the actuator disk 14, is transferred to the valve disk 6. The membrane 3 is made firmer and thicker for this illustrative embodiment.

Figure 9:
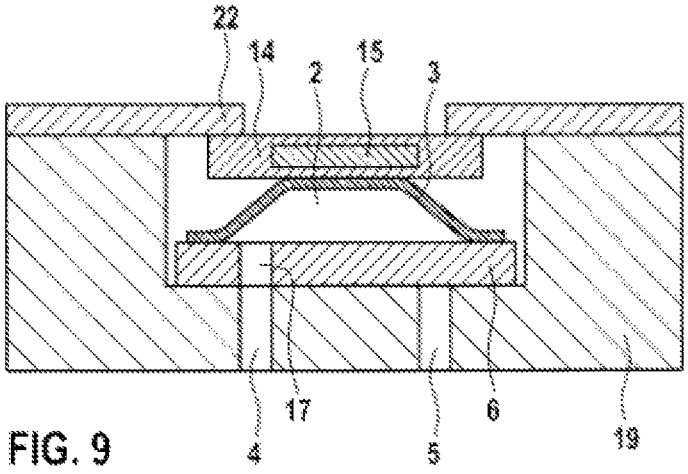
FIG. 9 shows a schematic sectional view of an embodiment of the membrane and of the pump chamber substrate.

FIG. 9 shows a schematic sectional view of an embodiment of the membrane 3 and of the pump chamber substrate 19. In this illustrative embodiment, the pump chamber substrate 19 has an abutment 22, which ensures that the actuator disk 14 cannot escape from the pump chamber substrate 19.

Figure 10:
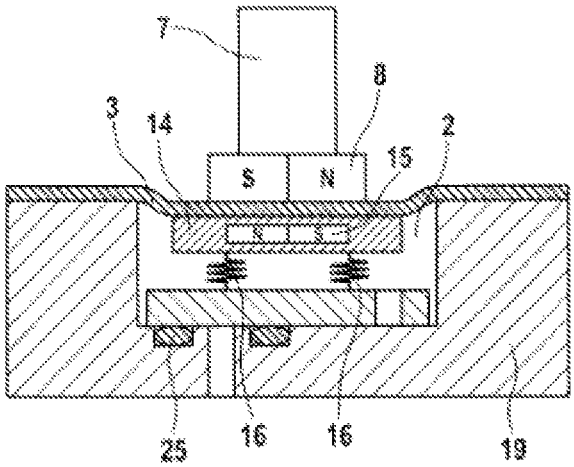
FIG. 10 shows a schematic sectional view of an embodiment of the micro-dosing pump.

FIG. 10 shows a schematic sectional view of an embodiment of the micro-dosing pump 1. In this illustrative embodiment, a seal 25 is provided underneath the valve disk 6 and arranged around the fluid line 4. The seal 25 can be configured, for example, as a plastic O-ring. The seal 25 seals the valve disk 6 off with respect to the pump chamber substrate 19, such that no fluid can accidentally pass outward through the fluid line 4 or enter the pump chamber 2.

Figure 11:
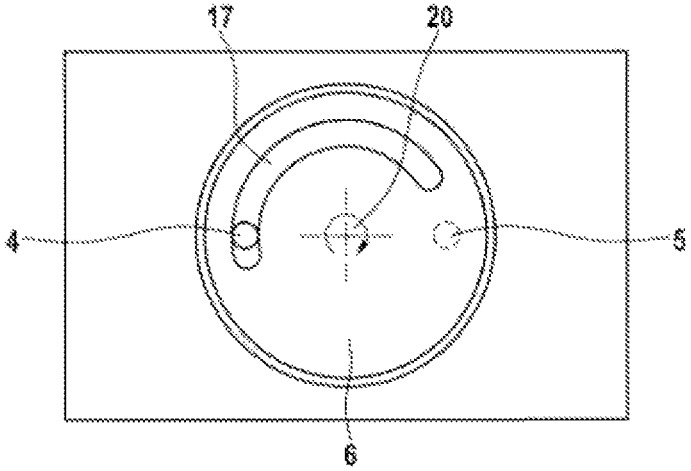
FIG. 11 shows a schematic sectional view of an embodiment of the valve disk and of the pump chamber substrate.

FIG. 11 shows a schematic sectional view of an embodiment of the valve disk 6. In this illustrative embodiment, only one fluid through-opening 17 is provided in the valve disk 6.

Although the present disclosure has been fully described above on the basis of preferred illustrative embodiments, it is not limited to these embodiments, and instead it can be modified in a variety of ways.

For example, a controlling and regulating device is coupled to the micro-dosing pump and controls and regulates the functions of the micro-dosing pump.

For example, a drive and dose control unit in the manner of a PDA (personal digital assistant) can also be provided, which controls and monitors the functions of the micro-dosing pump.

Batch production of the micro-dosing pump is also conceivable in which numerous pump chamber substrates are laid next to one another in one polymer substrate and, only after the membrane has been attached, are separated from one another by sawing or water-jet cutting or another separating procedure.

Moreover, an upper abutment for the pump membrane can be integrated into the structure so as to limit the stroke of the membrane.

Instead of a magnetic coupling of the torque from pump plunger 7 to actuator disk 14, a mechanical coupling is also possible for the embodiment shown in FIG. 9. For this purpose, the actuator disk 14 has depressions for the mechanical engagement of raised structures on the pump plunger 7 (or vice versa), e.g. in the form of the depressions on the front face of a cross-head screw and of the raised structure of a screwdriver for a cross-head screw. Advantageously, the contact faces are configured for torque transfer as far as possible parallel to the rotation axis.

What is claimed is:

1. A micro-dosing pump comprising:

a pump chamber substrate having a pump chamber;

a flexible membrane provided on a first side of the pump chamber substrate such that it covers the pump chamber in a fluid-tight manner;

at least one fluid line provided on a second side of the pump chamber substrate such that a fluid can enter and leave the pump chamber;

a rotatable valve disk having at least one fluid through-opening, the valve disk arranged inside the pump chamber and configured to close the fluid line by a rotation and to open it via the fluid through-opening;

a permanently magnetized or magnetizable actuator disk coupled to the valve disk via at least one resiliently elastic element such that rotating the actuator disk rotates the valve disk, wherein the resiliently elastic element is configured to press the valve disk and the actuator disk away from each other; and a drive unit having a magnetic pump plunger configured to move the membrane for suction or ejection of the fluid and configured to rotate the permanently magnetized or magnetizable actuator disk.

2. The micro-dosing pump as claimed in claim 1, wherein the drive unit has an electric motor.

3. The micro-dosing pump as claimed in claim 1, wherein the drive unit has a sensor which detects the stroke of the pump plunger.

4. The micro-dosing pump as claimed in claim 1, wherein:

the actuator disk has a recess in which a rod is provided, and the rod has one of a magnetizable material and a permanent magnetization.

5. The micro-dosing pump as claimed in claim 1, wherein at least one of the valve disk, the resiliently elastic element, and the pump chamber substrate are made from a plastic.

6. The micro-dosing pump as claimed in claim 1, wherein at least one of the valve disk and the resiliently elastic element are micro-punched.

7. The micro-dosing pump as claimed in claim 1, wherein the fluid through-opening of the valve disk is shaped as one of an arc and a circle.

8. The micro-dosing pump as claimed in claim 1, wherein:

the drive unit is a durable unit, and the pump chamber substrate, the membrane, the actuator disk and the valve disk are a disposable unit.

9. The micro-dosing pump as claimed in claim 1, wherein the resiliently elastic element is at least one of a beam spring, a plate spring and a spiral spring.

10. The micro-dosing pump as claimed in claim 1, wherein the membrane and the resiliently elastic element are formed in one piece.

11. The micro-dosing pump as claimed in claim 10, further comprising:

a mechanical coupling configured to transfer torque from the pump plunger to the actuator disk.

12. The micro-dosing pump as claimed in claim 1, wherein the membrane is made from one of a thermoplastic elastomer film and a structured thermoplastic.

* * * * *